US006393679B1

(12) United States Patent
Ascheman

(10) Patent No.: US 6,393,679 B1
(45) Date of Patent: May 28, 2002

(54) BURIAL SERVICE ASSEMBLY AND METHODS

(75) Inventor: John H. Ascheman, Hugo, MN (US)

(73) Assignee: Brown-Wilbert Incorporated, Roseville, MN (US)

( * ) Notice: Subject to any disclaimer, the term of this patent is extended or adjusted under 35 U.S.C. 154(b) by 0 days.

(21) Appl. No.: 09/447,324

(22) Filed: Nov. 22, 1999

(51) Int. Cl.[7] ..... A61G 19/00
(52) U.S. Cl. ..... 27/32; 27/26
(58) Field of Search ..... 27/32, 33, 34, 27/26, 35, 27

(56) References Cited

U.S. PATENT DOCUMENTS

| | | | | | |
|---|---|---|---|---|---|
| 1,450,092 | A | * | 3/1923 | Leavitt | 27/32 |
| 1,828,391 | A | * | 10/1931 | Canaday | 27/32 |
| 1,963,267 | A | * | 6/1934 | Harder et al. | 27/32 |
| 2,012,367 | A | * | 8/1935 | Wilkirson | 27/32 |
| 2,130,056 | A | * | 9/1938 | Austin | 27/32 |
| 2,147,858 | A | * | 2/1939 | Parker | 27/32 |
| 2,249,687 | A | * | 7/1941 | Eshleman | 27/32 |
| 4,413,390 | A | | 11/1983 | Blaese et al. | |
| 4,716,636 | A | | 1/1988 | Schneider | |
| 5,809,625 | A | | 9/1998 | Young et al. | |

OTHER PUBLICATIONS

Frigid Fluid Company; Casket Lowering Device; Parts List, 1 page. (undated).

* cited by examiner

*Primary Examiner*—B. Dayoan
*Assistant Examiner*—William L. Miller
(74) *Attorney, Agent, or Firm*—Anthony G. Eggink

(57) ABSTRACT

A burial service site assembly and method for viewing a casket at a specified location in a cemetery, remote from the grave site, prior to interment into a grave. The assembly comprises a base, a seating area, and a casket display and placing device. A casket is placed and secured on the casket display and placing apparatus during the burial service. Subsequent the service, the apparatus is moved and positioned over the opening of a burial vault. The casket is lowered into the burial vault and arranged for transport from the burial service site to a grave site. The apparatus is moved to its original position for a subsequent burial service.

24 Claims, 12 Drawing Sheets

BURIAL SERVICE ASSEMBLY AND METHODS

BACKGROUND OF THE INVENTION

This invention relates generally to a burial service assembly and method. Particularly, this invention relates to burial service assemblies and methods to transfer and position a casket for a burial service at a cemetery and to subsequently transfer the casket into a burial vault for interment at the grave site.

As part of a funeral proceeding it is common, subsequent a service at a church, synagogue, or funeral home, to have a service or ceremony at the cemetery. The burial service at the cemetery is typically attended by family and friends of the deceased. Preferably, the service at the cemetery is performed at a comfortable and pleasing location.

Several problems exist when providing burial services at a cemetery. A burial service provider typically sets up a service area for placement of the casket during the service and to provide a lowering device at the burial site. Several personnel are usually necessary to move the casket from the hearse to the casket viewing area and then for placement of the casket into the burial vault. Personnel are also necessary for subsequently lowering the vault into the grave. In summary, the service provider must present a burial service site that is both efficient for the servicing personnel and which is comfortable and pleasing to those attending the service.

Apparatus have been proposed and developed in the past relating to burial services at cemeteries. For example, U.S. Pat. No. 5,809,625 to Young et al. provides a method and apparatus for lowering a vault into a grave. The method uses a two unit apparatus and suggests the use of a specialized casket design in the method. U.S. Pat. No. 4,716,636 to Schneider provides a device that holds the vault above ground so that a casket can be placed into the vault. Schneider further provides a display platform for the vault lid and a mechanism for lowering the vault into the grave. U.S. Pat. No. 4,413,390 to Blase et al., discloses a generally rectangular-shaped casket-placer and casket lowering apparatus for supporting a casket over a grave opening during a graveside service.

These prior art references do not provide a comprehensive solution to the burial service problems discussed above and, as far as is known, no such assemblies and methods have been proposed or developed to provide an assembly and method for burial services at a cemetery which is economical, efficient and pleasant to both the provider and the service attendees.

An object of the present invention is to provide a centralized location for a burial service, comprised of an assembly and method that can efficiently be operated by a small number of personnel and which is pleasing and efficient to the service attendees.

The above objectives are accomplished in accordance with the present invention, by providing centralized locations for burial services at a cemetery. At the centralized location the casket is displayed, the burial service is performed and the casket is lowered into the burial vault. The vault with casket is then moved from the burial service site to the grave site. This efficient procedure allows for another burial service to be performed shortly after the vault is removed from the burial service site.

SUMMARY OF THE INVENTION

The invention relates to a burial service assembly and method. The burial service site assembly may be placed at a centralized location in a cemetery or several such assemblies may be located at preselected sites in a cemetery. The service site assembly comprises a casket display and placing apparatus which may be placed on a rigid base having a canopy and a seating area. Preferably, a burial vault is placed on the rigid base or in a lowered pit area of the rigid base. The casket display and placing apparatus is constructed and arranged so that a casket may be placed and secured on the apparatus for display during a burial service. The apparatus is also constructed and arranged so that the casket can be aligned over the vault and lowered therein. The assembly of the invention allows the burial service and the placement of the casket into the vault at the burial service location.

The casket display and placing apparatus includes a movable cart structure having a lowering mechanism assembly. The movable cart structure is constructed and arranged to transport and align the casket over the vault opening. The lowering mechanism assembly, positioned on top of the movable cart structure, has means to lower a casket that is placed on the lowering mechanism assembly, through the interior of the frame structure and into the vault. The lowering mechanism assembly further provides means to aid the operator when placing the casket on the display surface. The assembly and method of the invention permits generally one attendant to perform the entire operation of placing the casket for display and lowering the casket into a vault. These and other benefits of this invention will become clear from the following description by reference to the drawings.

DESCRIPTION OF THE PREFERRED EMBODIMENTS

Figure 1:
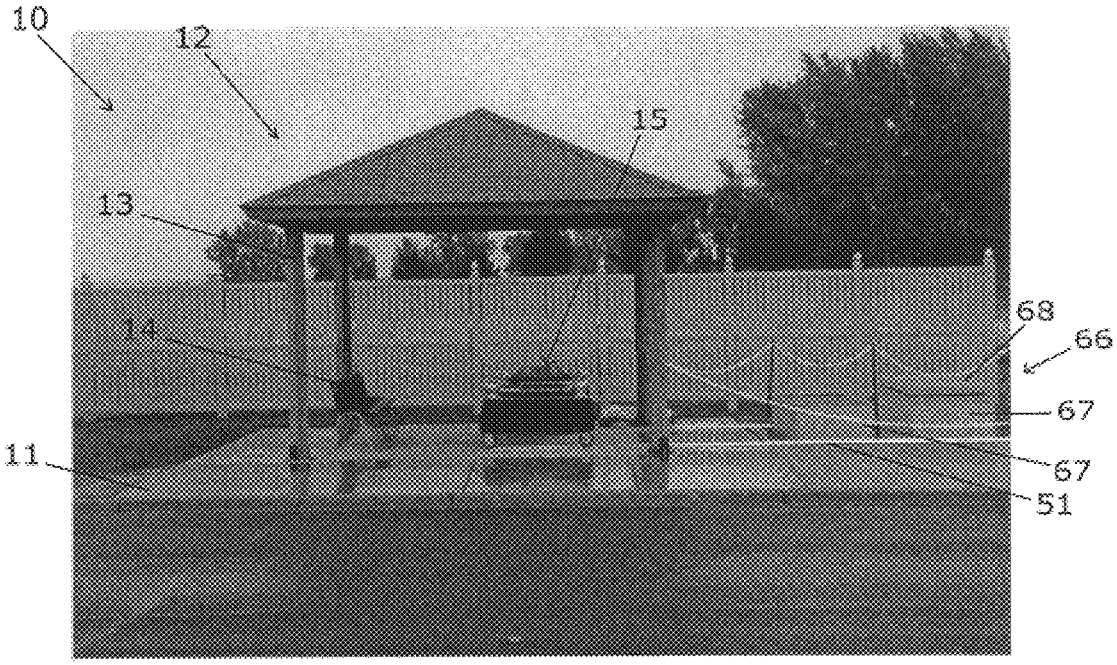
FIG. 1 is a perspective view of the burial service site assembly of the present invention.

The present invention relates to burial service assemblies and methods. The burial service assemblies and method of this invention are particularly useful for burial service providers at cemetery sites and particularly in cemeteries having a large volume of burials. The invention permits burial services to be performed at a designated cemetery site or a plurality of sites in an efficient manner and by a small number of personnel. The assembly of the invention provides an efficient centralized location and can be easily prepared for burial services. The assembly and method provide mechanisms and methods of operation that can be operated by a single person if necessary.

Referring to FIGS. 1–5, a burial service site assembly 10 is shown having a rigid base structure 11. A canopy 12 having support members 13 and a roof is shown fixed to and covering a portion of the base structure 11. A seating area 14 comprising a plurality of chairs is shown on base structure 11 below canopy 12. A casket display and placing apparatus 15 is shown positioned on rigid base 11 and within the confines of the canopy 12.

The casket display and placing apparatus 15 includes a movable frame structure 16 having wheels 47 which are placed for movement on spaced rail members 51. The rail members 51 are shown fixed to the rigid base 11 and extend from a first position under canopy 12 to a sunken vault pit area 66 wherein vaults 67 are positioned.

The casket display and placing apparatus 15 is constructed and arranged to receive a casket from a hearse for display and securement during the burial service. Thereafter, the apparatus 15 is moved on rails 51 and positioned over a vault 67. The apparatus 15 is next activated to lower the casket into vault 67, the cover 68 is placed onto vault 67 and the casket and covered vault are removed form the pit area 66 and transported to the grave site.

As further shown in FIGS. 1–5, the movable frame structure 16 is comprised of a lower horizontally disposed side frame member 17, an upper horizontally disposed side frame member 21, lower and upper horizontally disposed front frame members 18, 22, lower and upper horizontally disposed rear frame members 19, 23 and which are connected to front vertically disposed frame members 24 and rear vertically disposed frame members 27. A U-shaped base plate 28 is shown fixed to the tops of the vertically disposed frame members 24 and 27. Held between the U-shaped base plate 28 and the upper horizontal frame members is skirt or drapery 75 which decorates the casket display and placing apparatus 15.

The apparatus 15 is further shown to have an upper portion or lowering mechanism assembly 26 connected to the top of the U-shaped base plate 28 and on which the casket is placed for display. The upper portion is shown comprised of corner head units 29 and between which front rail member 32, rear rail member 33 and rotatable side rail members 34 are positioned. As shown, straps 37 are wrapped around and extend between the rotatable side rail members 34. As will be further described this upper mechanism is known in the art as a casket lowering device and sold by Frigid Fluid Company of Chicago, Ill., for example. These casket lowering devices are constructed whereby an arrangement of gears, shafts, brakes and governors are disposed within the hollow rail members 32, 33 and 34 which permit an operator to activate a lever on one of the corner head units to automatically lower a casket on straps 37. It is within the purview of the invention that other lowering mechanism assemblies may be adapted to be used with the cart frame structures shown herein. As further shown a pair of removable roller units 38 are positioned over the rotatable side rail members 34. Each roller unit 38 is shown comprised of a roller unit base 53 having an indented lower area at each end to engage the opposing side rail members 34. A roller member 52 is positioned above each base 53. Although removable roller units 38 are shown herein, it is within the purview of the invention to utilize other roller and securement assemblies which are positioned on the casket display and placing apparatus and which may be temporarily moved away from the display surface to permit the casket to be supported by the straps 37 for subsequent lowering into a vault 67.

Figure 2:
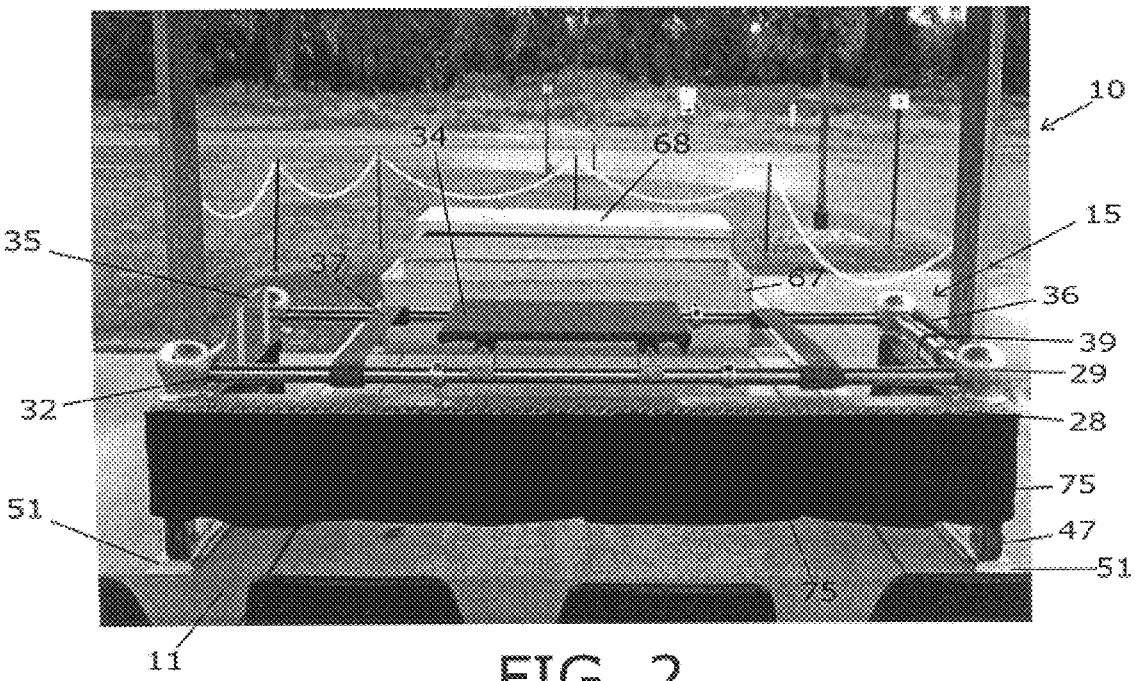
FIG. 2 is another perspective view of the burial service site assembly of FIG. 1.
Figure 3:
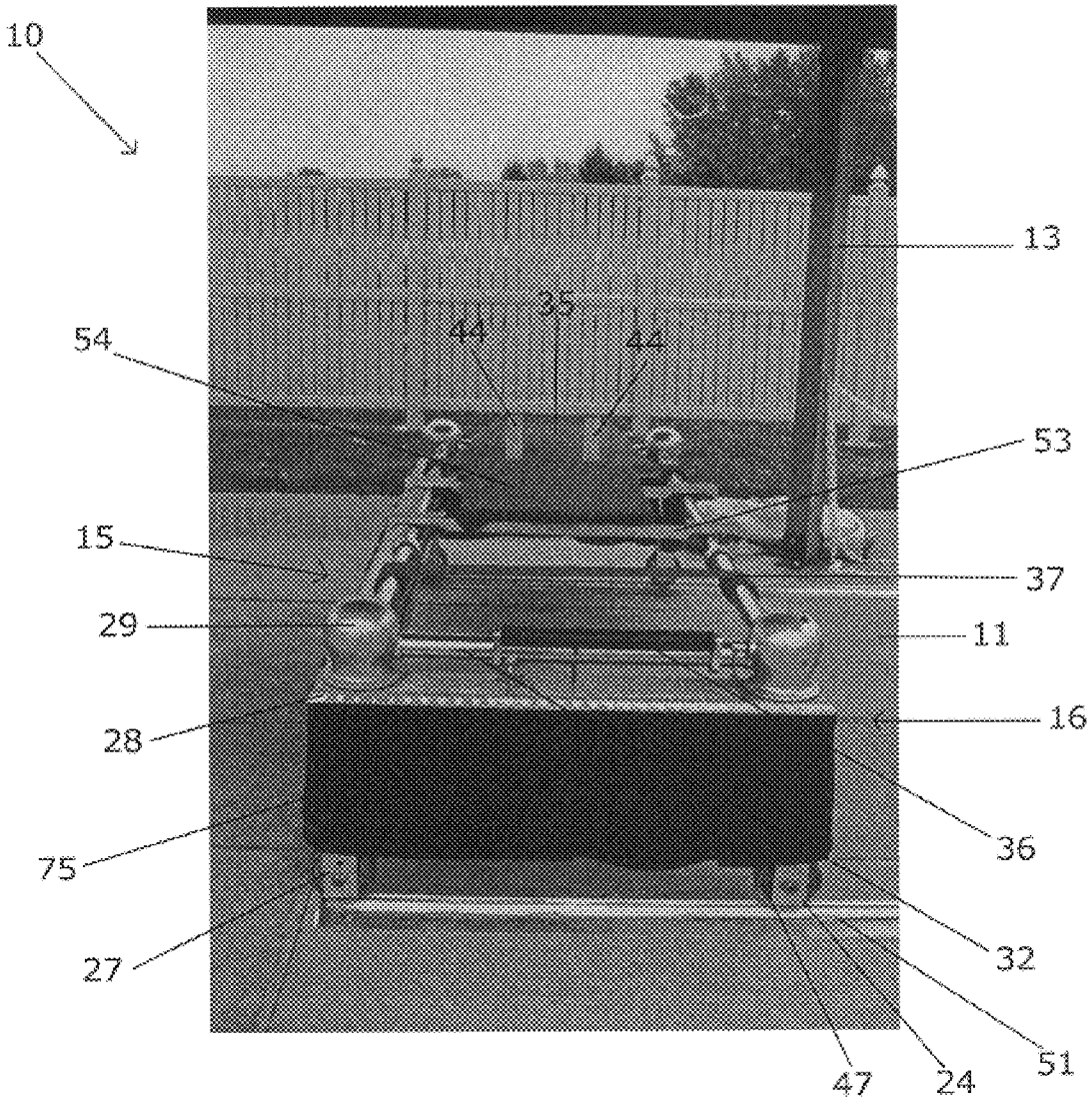
FIG. 3 is a front perspective view of the casket display and placing apparatus of the assembly of FIG. 1.
Figure 4:
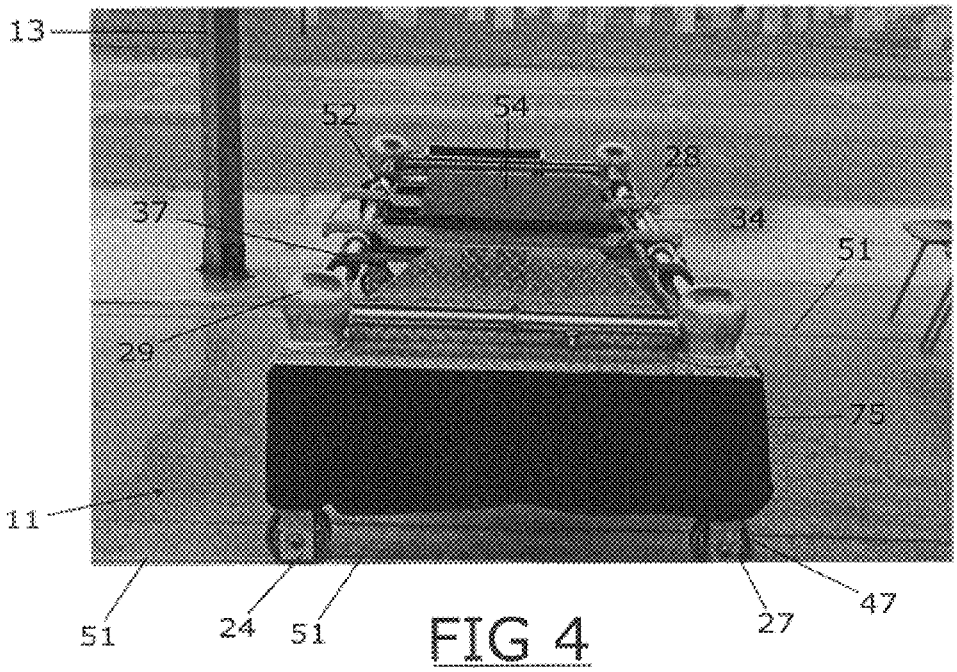
FIG. 4 is an end view of the apparatus of FIG. 3.
Figure 5:
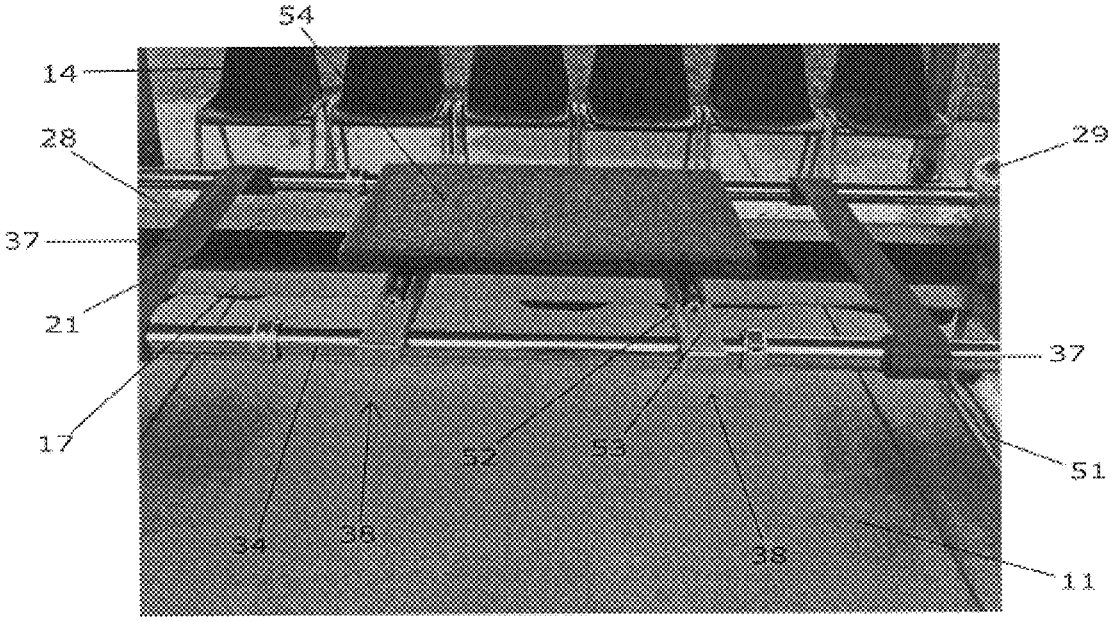
FIG. 5 is an enlarged view of a portion of the apparatus of FIG. 3.

Shown particularly in FIGS. 2–4, a roller member 36 is positioned above front rail member 32 and a stop plate 35 is shown fixed to the U-shaped base plate 28 in front of the rear rail member 33. The stop plate 35 may be secured to or formed as part of the base plate 28. In operation, a casket is removed from hearse and rolled on front roller member 36, removable roller units 38 and placed against stop plate pads 44 mounted to the casket stop plate 35. As shown in the drawings, a platform 54 may be placed on the removable roller units 38 so that a cremation urn may be placed thereon for the ceremony at the cemetery. Further structural details of the invention will be further discussed below with respect to other embodiments of the invention.

The burial service assembly of the invention is shown in several embodiments which include various cart frame structures supporting the casket display and placing apparatus. The latter apparatus including the casket lowering device. The various cart frame structures include frames of varying heights and having varying side openings to permit a predetermined alignment position for lowering the casket into the vault. The various cart frame structures also include differing movement means.

The cart frame structure 16 of the first apparatus embodiment 15, for example, includes vertical frame members 24 and 27 which have a predetermined height whereby the apparatus 15 has a horizontally disposed working plane which aligns with the rear of a hearse for casket movement and which aligns with the seating area 14 and the top of the vault 67 for lowering of the casket therein.

Figure 6:
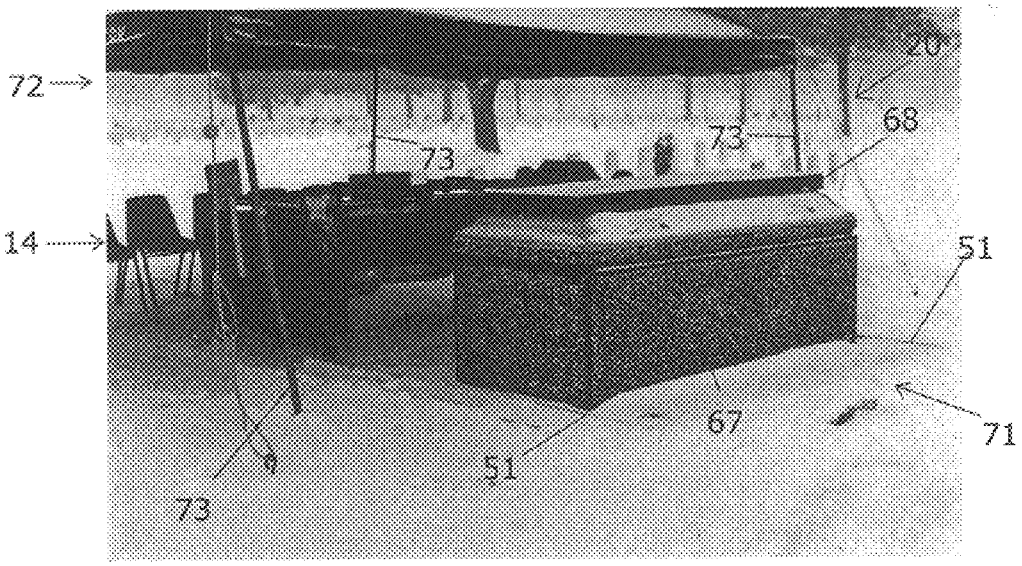
FIG. 6 is a perspective view of another embodiment of the burial service site assembly of the present invention.

FIG. 6 is a perspective view showing the burial service assembly 20. The assembly 20 is shown to have a rigid base 71, a seating area 14, a canopy 72 including support members 73, and a casket display and placing apparatus 25. As further shown in FIG. 7, the casket display and placing apparatus 25 is comprised of a cart-like structure 74 and lowering mechanism assembly 26. As shown in FIG. 6, a vault 67 having a vault lid 68 is shown placed on rigid base 71. The casket display and placing apparatus 25 is guided across the rigid base 71 on wheel guidance tracks 51 as shown in FIG. 6.

Figure 7:
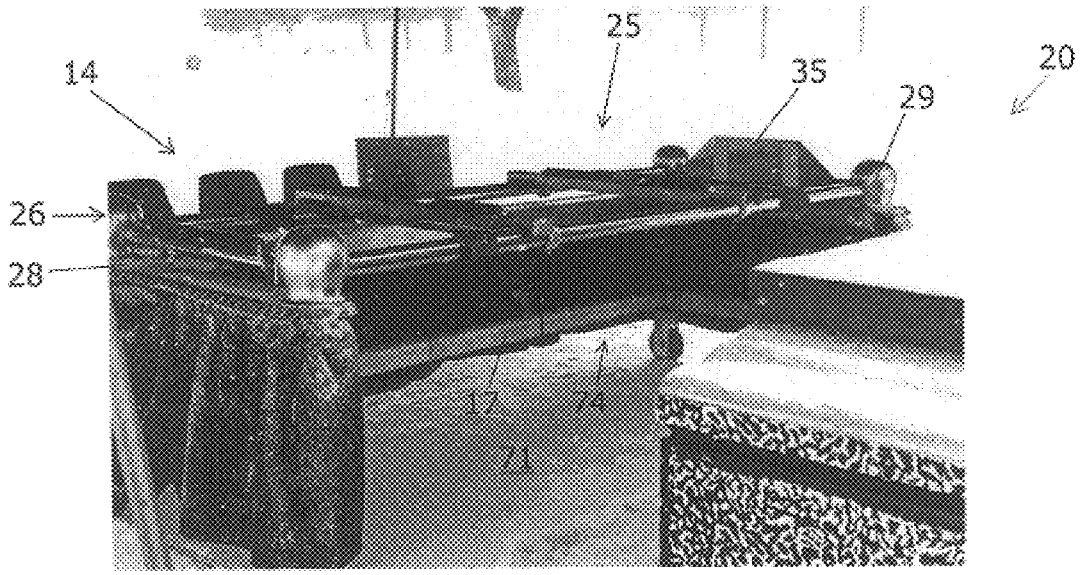
FIG. 7 is a perspective view of the casket display and placing apparatus of the assembly of FIG. 6.
Figure 8:
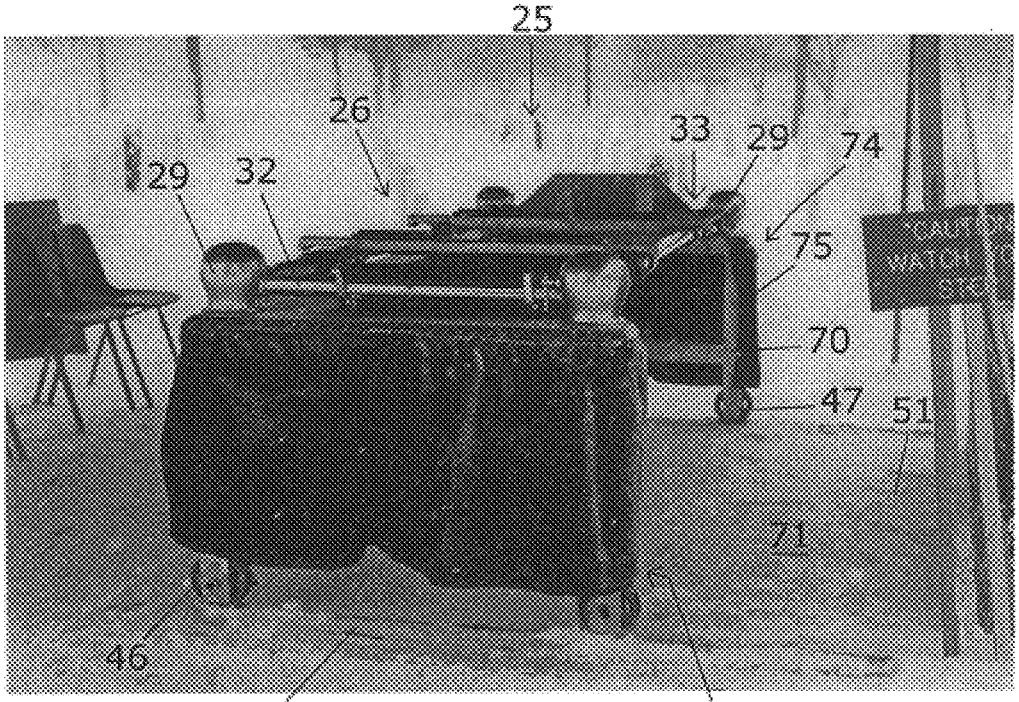
FIG. 8 is a front perspective view of the casket display and placing apparatus of FIG. 7.
Figure 9:
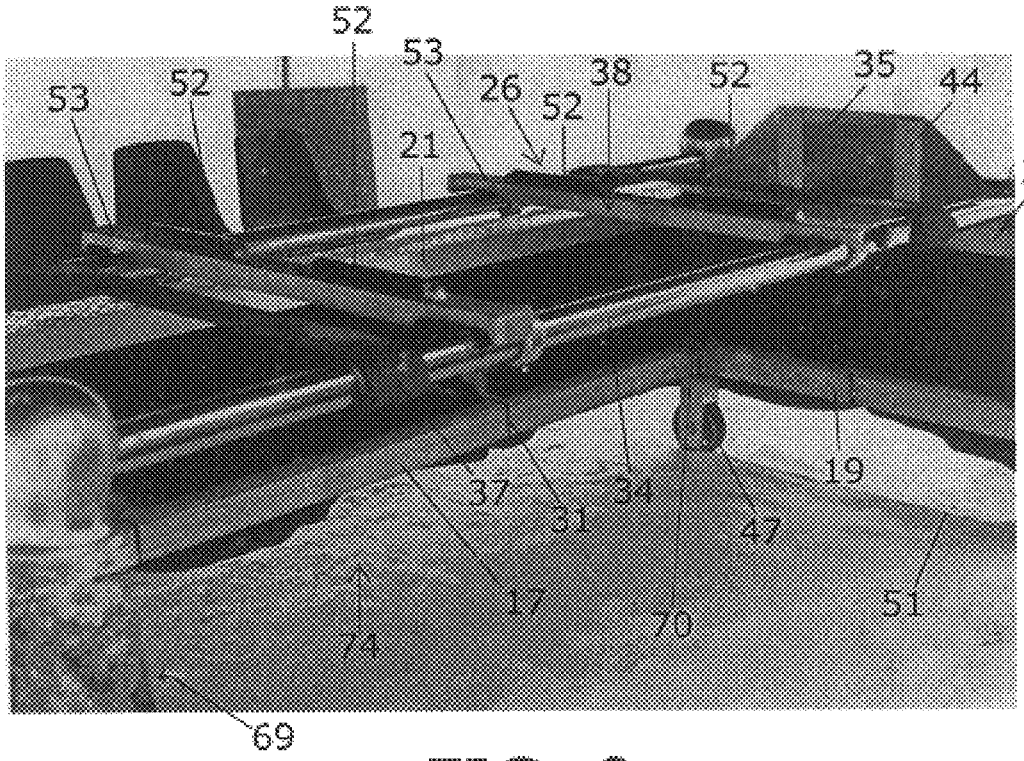
FIG. 9 is a side perspective view of the casket display and placing apparatus of FIG. 7.
Figure 20:
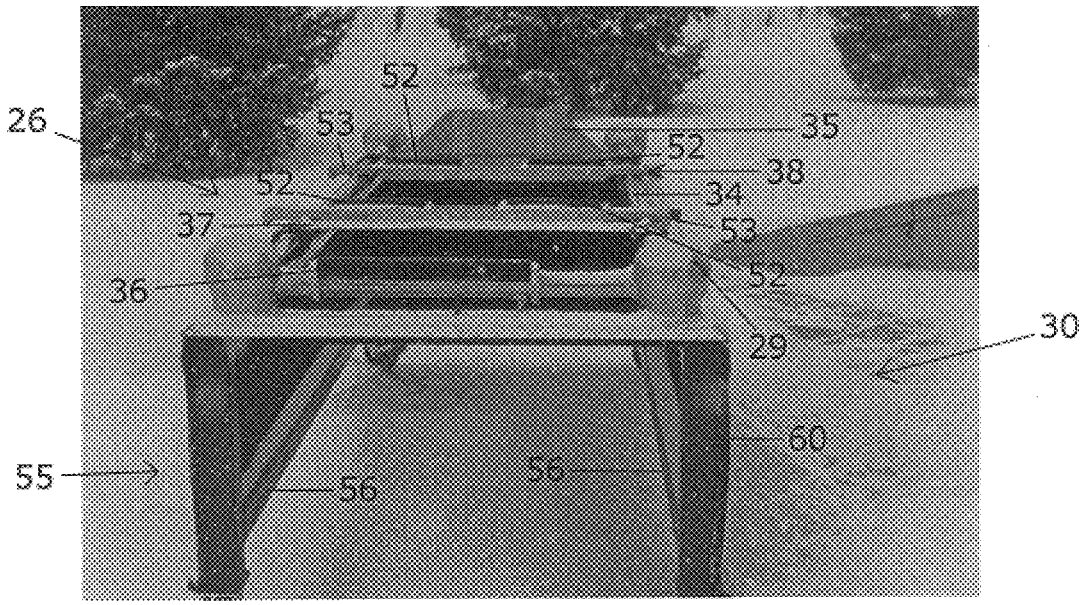
FIG. 20 is a perspective view of another embodiment of the casket display and placing apparatus of the present invention.
Figure 21:
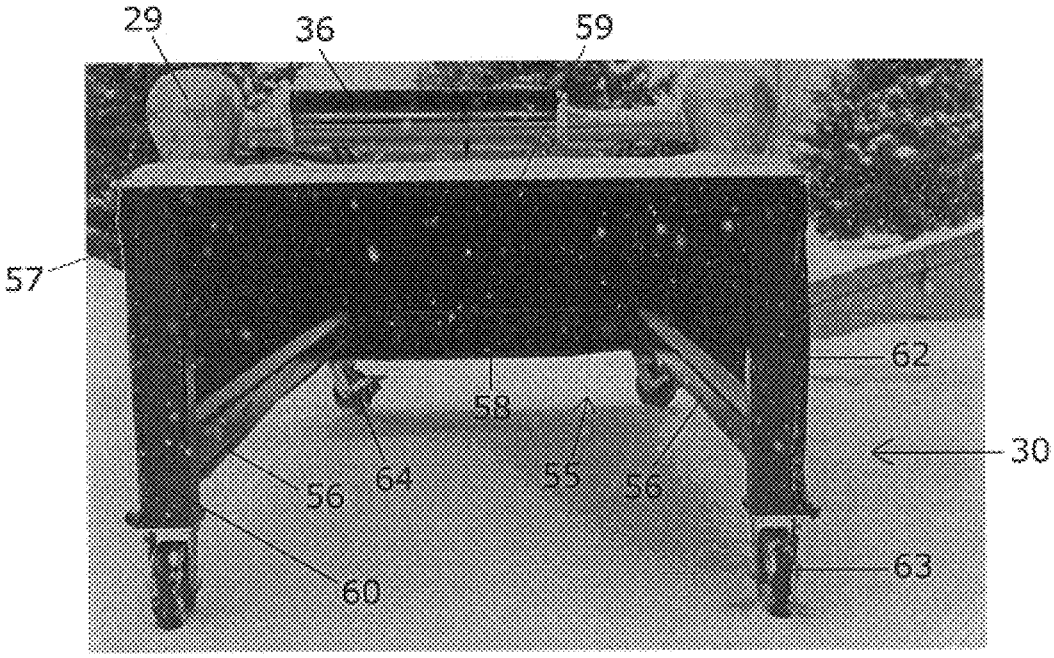
FIG. 21 is a front perspective view of the apparatus of FIG. 20.
Figure 22:
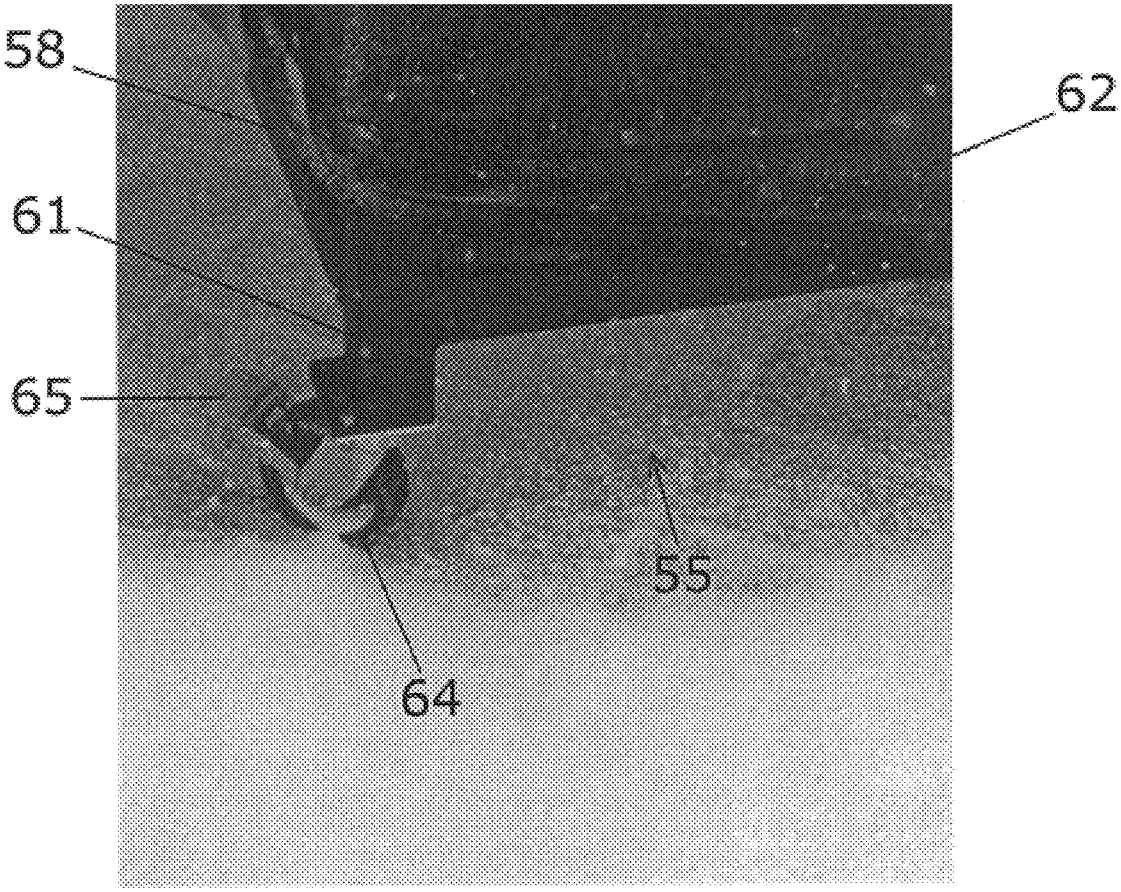
FIG. 22 is a perspective view of the embodiment of the wheel locking mechanism of the apparatus of FIG. 20.

The cart structure 74, as shown in FIGS. 7–9 is shown comprised of generally rectangular frame members 17–19 and 21–24, 27 preferably made of steel or like material, and which form the generally rectangular frame structure of the frame 74. The rectangular cart frame structure 74 is shown to have a side opening to allow vault 67 to be positioned within the confines of the structure 74. The structure 74 is constructed and arranged to allow the casket to be lowered between the top frame members 21–23 and into the confines of vault 67. FIGS. 6–19 show embodiment 25 of the casket display and placing apparatus having cart structure 74. FIGS. 20–22 show another embodiment 30 of the casket display and placing apparatus having the cart-like structure 65, which will be further discussed below. The cart embodiments permit the frame structure to be moved and positioned over an open vault whereby a casket can be lowered into the confines of the vault.

FIG. 7 shows embodiment 25 of the casket display and placing apparatus of the present invention having frame structure 74, which has an open side which permits the frame 74 to be positioned over vault 67. Lower horizontal frame member 17 can be seen supporting frame 74. Lowering mechanism assembly 26 is shown atop frame structure 74. Lowering mechanism assembly 26 is shown having U-shaped base plate 28, corner head units 29, and casket stop plate 35.

As also shown in FIG. 7, the corner head unit 29 has a lowering release mechanism 41 which allows the side rail members 34 to be rotatable and thereby permit the casket lowering straps 37 to be utilized to lower a casket.

FIG. 8 shows casket display and placing apparatus 25 comprising cart frame structure 74 and lowering mechanism assembly 26. The lowering mechanism assembly 26 is fastened to the top of cart frame structure 74 by means of corner head units 29 being placed over mounting pins (not shown) attached to vertical support members 69 and 70. Rear vertical frame support 70 can be seen supporting frame structure 74 and having rear wheels 47. For placement over a vault, casket display and placing apparatus 25 is moved along guidance track 51 on rigid base 71 with front wheels 46 and rear wheels 47. Wheels 46 and 47 may be constructed of any material known in the art such as metal, plastic, rubber, and the like.

The cart frame structure 74 may be constructed in a variety of ways to provide an aesthetically pleasing display structure for the burial service. As shown, skirt or drapery 75 is fixed around the cart frame structure 74 by skirt fasteners 31 to provide an aesthetically pleasing structure. The skirt 75 may be constructed from any drapery-type material known in the art such as nylon, velvet, and like materials. The skirt 75 may also be a solid panel attached to the casket display and placing apparatus 25 such as plastic, wood, or metal paneling and the like, and may be attached by any means known in the art. The corner head units 29 may have any desired shape, such as round, square, cylindrical, sculpted shapes, and the like and may be constructed of any material known in the prior art such as chrome plated steel and the like.

FIG. 9 shows a side perspective view of cart frame structure 74 and lowering mechanism assembly 26. Cart frame 74 is shown supported by lower horizontal frame members 17 and 19 on the side and rear, respectively, and upper horizontal frame members 21 and 23 on the side and rear, respectively. Upper and lower frame members of the front, side and rear of cart frame 74 are connected by vertical frame members 69 and 70 to form a generally rectangular frame shape with an opening on one side for placement around a vault. Vertical frame members 69 and 70 are connected to wheels 46 and 47, respectively. As shown, wheel 47 is positioned on wheel guidance rack 51 for movement to the vault.

Figure 10:
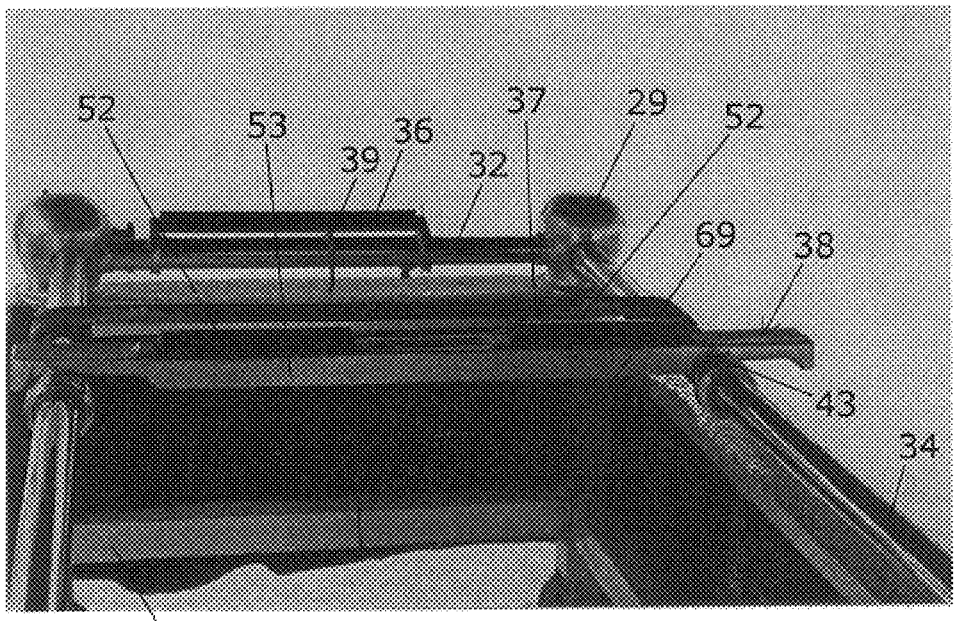
FIG. 10 is a perspective view of the front portion of the casket display and placing apparatus.

The lowering mechanism assembly 26 is shown in FIGS. 9 and 10 comprised of two fixed end rail members 32 and 33 and two rotatable side rail members 34. The end and side rail members are connected at their ends with corner head units 29. Although round cross-sectional members are shown, the rail members may have other cross-sectional shapes and may be made of any material commonly known in the art such as chrome-plated steel and the like. The rail member 32 is secured to cart frame structure 74 by an anchoring member 39 although other securement means may be used. Casket lowering straps 37 are releasably attached to the rotatable side rail members 34 at each end of straps 37 and are preferably made of flexible nylon material or the like. The side rail members are rotated to wind straps 37 around the rail members 34 until straps 37 are stretched tightly between side rail members 34. The straps 37 are tightened until they can support the weight of a casket to be lowered into vault 67.

The lowering assembly 26 preferably has a conveyor means comprising an upper conveying portion preferably having a plurality of roller members. Removable roller units 38 preferably may be placed spanning between the side rail members 34. The removable roller units 38 are removed prior to lowering the casket into vault 67. The removable roller units 38 consist of at least one roller member 52, preferably cylindrical in shape, connected to a base roller unit 53. The roller unit base 53 is shown in FIG. 10 to be of a length to securely rest on both rotatable side rails 34. The base 53 preferably is constructed with indentations on each end that engage side rails 34 to aid in securing roller units 38 to the top of assembly 26.

Figure 11:
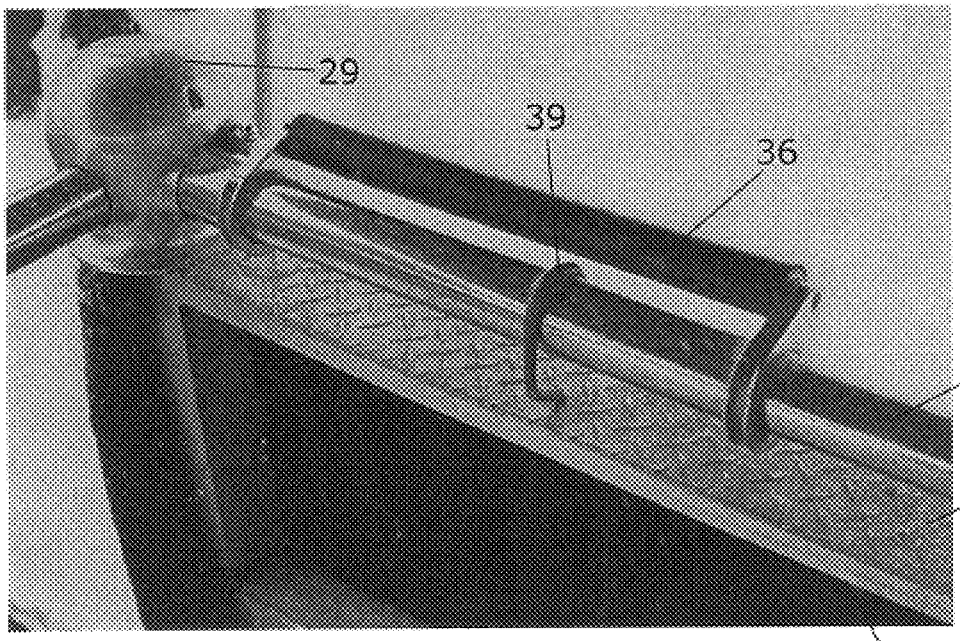
FIG. 11 is a perspective view of the apparatus of FIG. 10.

Front roller member 36 is shown in FIGS. 10 and 11. Front roller member 36 is attached to front end rail member 32 and is shown cylindrical and elongated in shape. Front roller member 36 is aligned with and used in conjunction with roller members 38 to ease the movement of the casket on lowering mechanism assembly 26. The roller 36 may be free rolling. The roller members 36 and 52 are shown constructed of rubber, however other compositions such as plastic, metal, or the like may be used. FIG. 11 further shows part of U-shaped base plate 28 atop upper horizontal front frame member 22.

Figure 12:
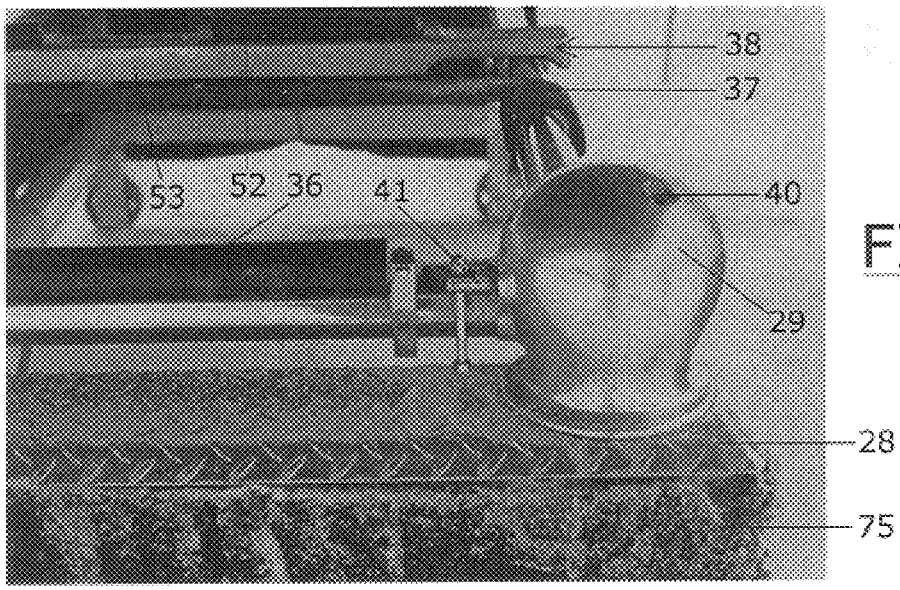
FIG. 12 is a perspective view of a front corner of the assembly of FIG. 7.

FIG. 12 shows skirt 75 fixed around the cart frame structure 16 and secured to the cart by capturing the top of skirt 75 between the top frame members of the cart frame structure 74 and the U-shaped base plate 28. The U-shaped base plate 28 is preferably an ornamental structure, constructed of aluminum, but may be constructed from any materials known in the art such as metal, wood, plastic, and the like. The casket is lowered by releasing the lowering release mechanism 41, whereby the rotatable side rail members 34 are freed at their ends to rotate, thereby unrolling and extending straps 37 and lowering the casket resting thereon. Subsequent the lowering process, the straps 37 are rewound and retightened using reset mechanism 40.

Figure 13:
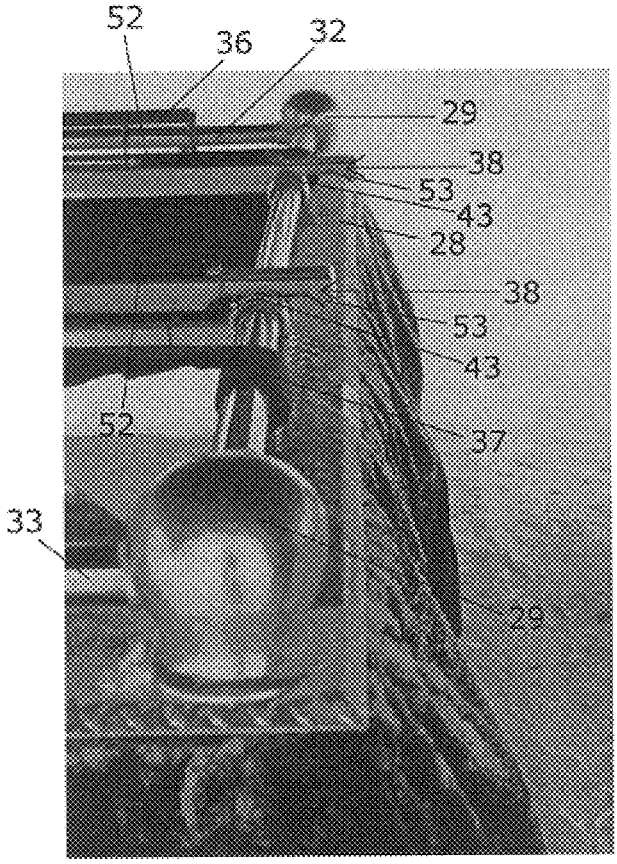
FIG. 13 is a rear perspective view of a side portion of the assembly of FIG. 7.

FIG. 13 shows a rear view of the side of lowering mechanism assembly 26. Lowering mechanism assembly 26 is shown comprising front rail member 32, side rail member 34 and rear rail member 33 connected by corner head units 29. Casket lowering straps 37 are shown stretched between and connected to side rail member 34. Front roller member is shown on front rail member 32. Removable roller units 38 are shown resting on side rail member 34 and comprising roller member 52 and roller unit base 53.

The vault 67 is typically provided with a plurality of spaced pegs or supports extending from the vault bottom to space or elevate the casket from the bottom of the vault. The flexible straps 37 attached to and wound about the rotatable side rails 34 are spaced and aligned whereby when the casket is lowered into the vault the straps are positioned outside the spaced vault supports to permit slidable removal of the straps around the opposite ends of the casket. Subsequent the strap movement, the respective straps are rewound, tightened and locked about the side rails 34.

Figure 14:
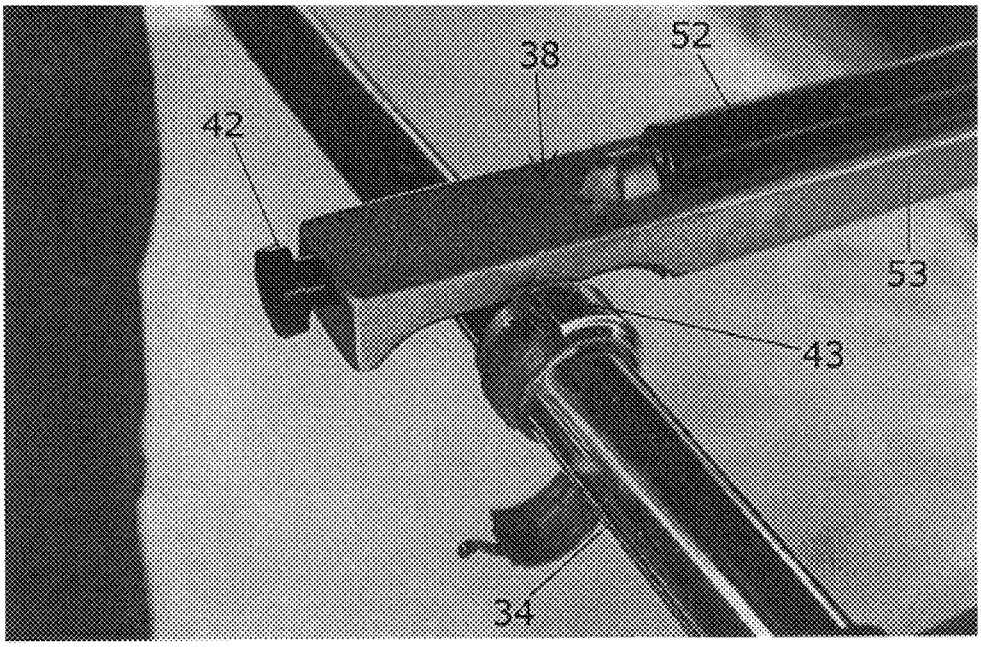
FIG. 14 is a perspective view of the lowering mechanism.

FIG. 14 shows the rotatable side rail member 34 supporting the removable roller unit 38. The removable roller unit 38 has a base member 53 with a cutout portion on the bottom of its ends which rest on the rail member 34. A stop member 43 is shown attached to the rail member 34 to fix the roller unit 38 with respect thereto. The base member 53 is shown to have a lock knob 42 attached thereto and which is in communication with the roller member 52. The roller member 52 is immobilized by means of lock knob 42 after a casket is placed thereon and to thereby prevent the casket from moving. The lock knob 42 may be connected to a shaft which when turned engages the roller member 52 to thereby brake the rolling motion of the roller member 52. The removable roller units 38 with bottom indents to engage the rail members and are removed therefrom to thereby allow the casket to be lowered with respect to the cart frame structure 74.

Figure 15:
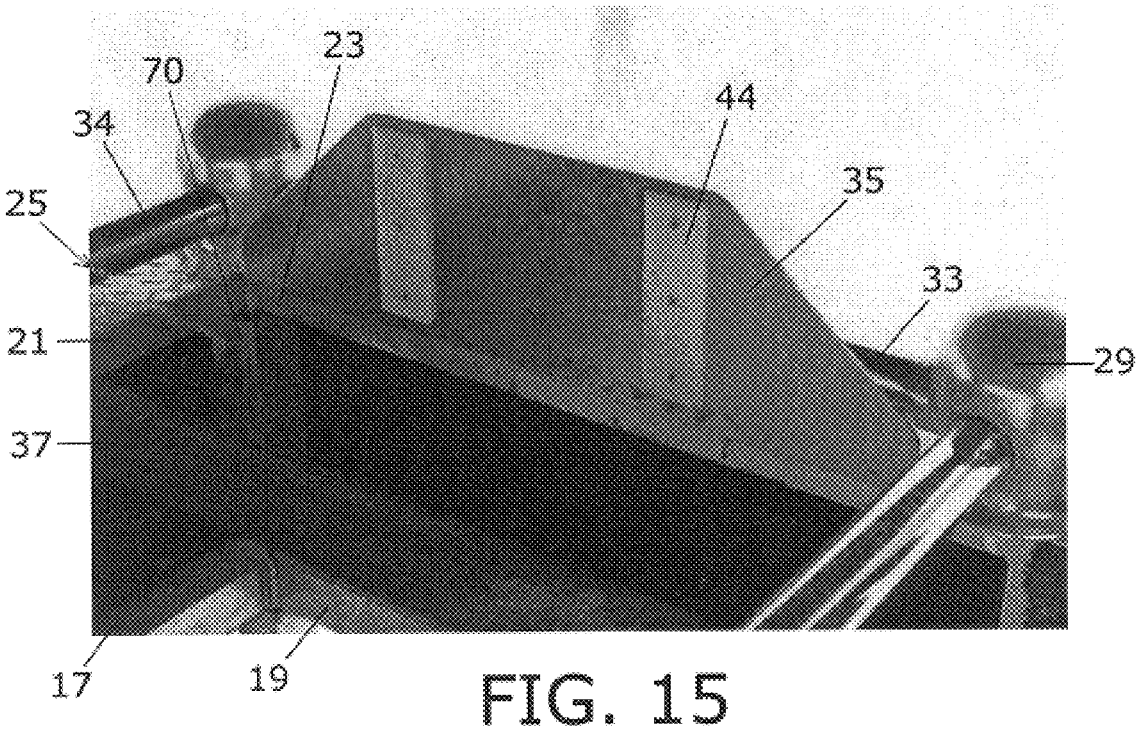
FIG. 15 is a front perspective view of the casket stop plate.
Figure 16:
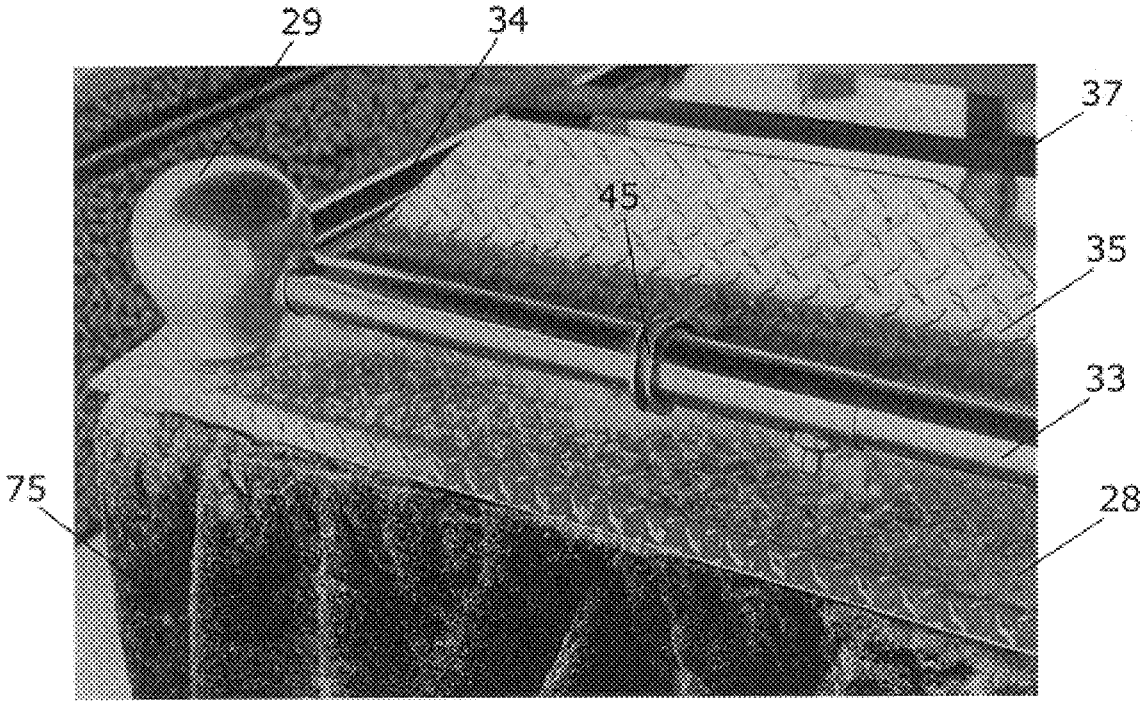
FIG. 16 is a rear perspective view of the casket stop plate.

FIGS. 15 and 16 show a front and rear views, respectively, of the casket stop plate 35 of the lowering mechanism assembly 26. The casket stop plate 35 retains placement of the casket on the lowering mechanism assembly 26. Casket stop plate 35 is shown extending upwardly from the lowering mechanism assembly 26 and is positioned at the rear end of casket display and placing apparatus 25 to ensure that the casket is properly positioned on lowering mechanism assembly 26. The stop plate structure 35 is shown to have pads 44 to prevent damage to the casket during positioning. The stop plate 35 is preferably made of a rigid material, such as metal or the like and stop plate pads 44 are preferably made of plastic, foam rubber, or the like. Also shown in FIGS. 15 and 16 are casket lowering straps 37, rear anchoring member 45, corner head units 29, U-shaped plate 28, side rail member 34 and rear rail member 33 of lowering mechanism assembly 26 and skirt 75, upper horizontal side and rear frame members 21 and 23, lower horizontal side and rear frame members 17 and 19, and rear vertical frame support member 70 of cart frame structure 74.

Figure 17:
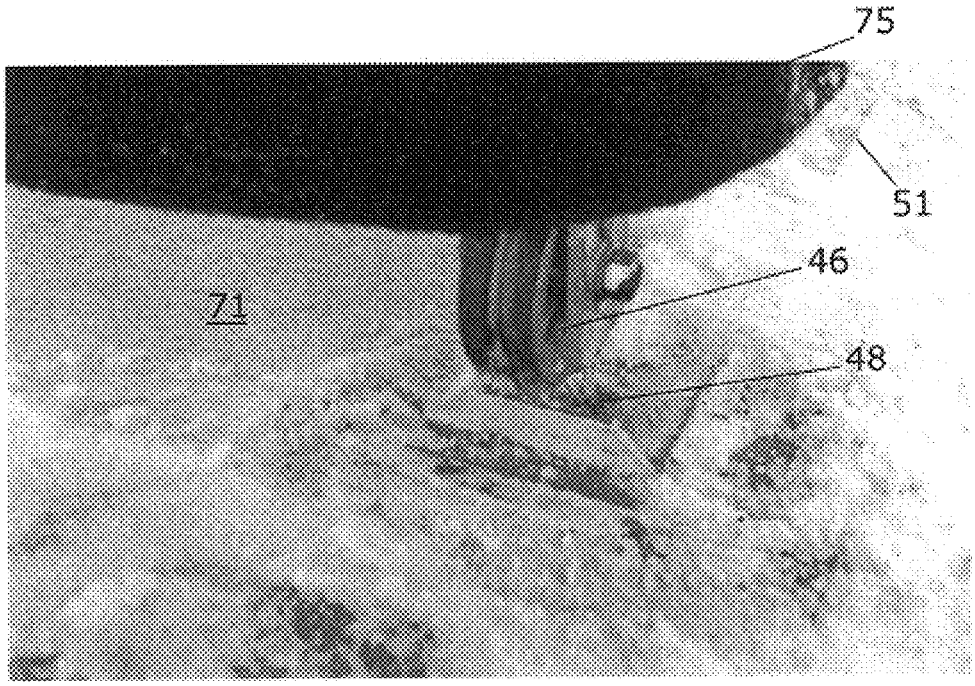
FIG. 17 is a perspective view showing the rail/wheel arrangement of the assembly of FIG. 6 and FIG. 1.
Figure 18:
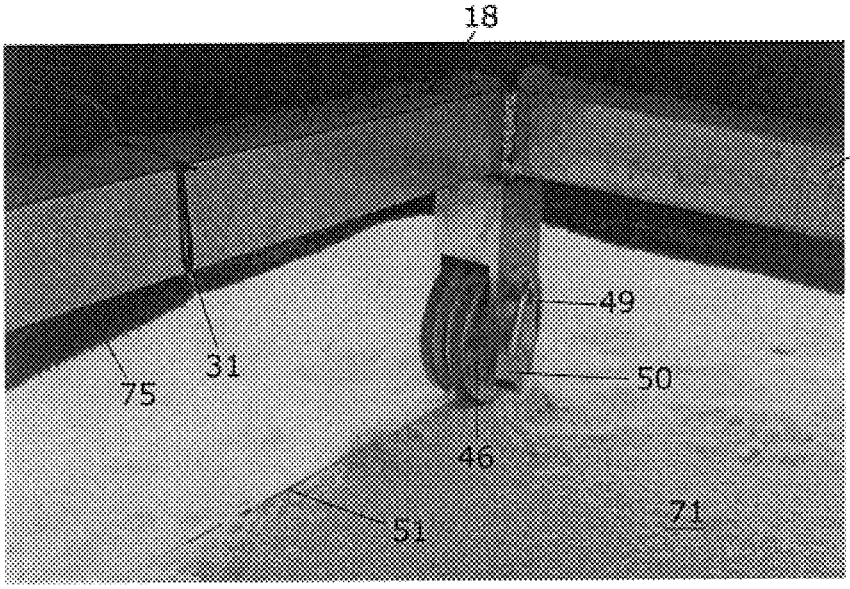
FIG. 18 is a perspective view showing the wheel locking mechanism.
Figure 19:
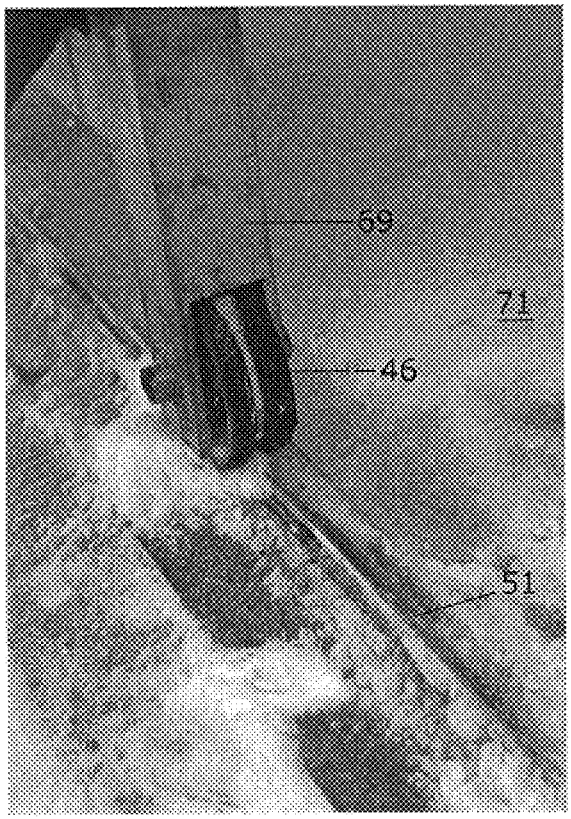
FIG. 19 is a perspective view of the wheel track.

FIGS. 17–19 show an embodiment of a wheeling device that can be used with casket display and placing apparatus 25. FIG. 17, shows wheel 46 having a centrally disposed peripheral groove to engage and roll on wheel guidance track 51. A wheel stop plate 48 may be placed at one or both ends of each wheel guidance track 51 to maintain the casket display and placing apparatus 25 on tracks 51. Preferably, wheel stop plate 48 is constructed of metal, such as steel or the like. The wheels 46 and 47 may be constructed of any material known in the art such as metal, plastic, rubber, and the like.

FIG. 18 shows wheel 46 for moving along wheel guidance track 51. Wheel 46 has a locking mechanism having a locking pin 49 and a lock 50. The locking pin 49 passes through apertures in vertical support member 24 positioned on either side of wheel 46 and through aligned aperture in wheel 46. The lock 50 may then be placed through an aperture in locking pin 49 to keep pin 49 in place. A locking mechanism enables the casket display and placing apparatus 25 to be temporarily fixed in a position on track 51 when placing the casket onto the apparatus 25 and to provide a fixed display platform. The locking mechanism may be any suitable locking mechanism known in the art. FIG. 19 shows wheel 46 attached to vertical support member 24 and in position along wheel guidance track 51 in rigid base 71.

FIGS. 20–22 show embodiment 30 of casket display and placing apparatus. Casket display and placing apparatus 30 is comprised of cart-like frame structure 55 and lowering mechanism assembly 26. Cart frame structure 55 has a generally rectangular structure and is comprised of upper and lower horizontal side frame members 57 and 56, respectively, upper and lower rear frame members 59 and 58, respectively, and front and rear vertical frame support members 60 and 61, respectively. The frame members 56–61 are generally rectangular and are constructed of steel or like material. The generally rectangular cart frame structure 55 has a front opening to allow vault 67 to be positioned within the confines of structure 55.

FIG. 20 is a front view of casket display and placing apparatus 30 showing lower horizontal frame members 56 and front vertical support members 60 comprising cart frame structure 55. Lowering mechanism assembly 26 is shown comprising corner head units 29, side rail members 34, casket stop plate 35, casket lowering straps 37, roller members 52, and roller unit bases 53. FIG. 21 is a front view of casket display and placing apparatus 30 showing lower horizontal side and rear members 56 and 58, respectively, and front vertical support members 60. Wheels 63 and 64 are shown attached to the bottom end of the vertical support members 60 and 61. Cart frame structure 55 is further shown to have a skirt or peripheral drapery 62. Corner head units 29 and front roller member 36 are also shown.

FIG. 22 shows an alternate embodiment of a wheel structure that may be used in the casket display and placing apparatus 30. Wheel 63 and 64 do not have a groove and are not guided by a track system. Wheels 63 and 64 are rotatable and can therefore be used to position casket display and placing apparatus 30 in any way desired. The wheels 63 and 64 preferably have a locking mechanism such as wheel stopping member 65 which is releasable. Releasable wheel stopping member 65 is pressed against the surface of wheel 64 or 63 to frictionally hold the casket display and placing apparatus 30 in position.

In summary, the burial service assembly is constructed and arranged to provide a display area for a casket at a cemetery and to transfer and place the casket into a burial vault. As shown in the drawings, the display area includes a rigid base, a canopy having support members, and a seating area. The rigid base may be constructed of such materials as prepared ground, wood, concrete, stone, or the like. The canopy may be constructed from textiles such as nylon, canvas or plastic and its support members may be constructed of metal, stone, wood, or the like. The seating area is preferably large enough to provide placement of an adequate number of chairs for service attendees and enough space for a speaker to perform a burial service. The vault and vault lid may be constructed of any material known in the art, such as concrete, for example. As described above, the casket display and placing apparatus is wheeled across the rigid base of the burial assembly. Preferably, the wheel guidance tracks are constructed of metal, such as steel or the like.

The method for conducting a burial service according to this invention is comprised of conveying a casket onto a display surface on a casket display and placing apparatus 15, 25 or 30. The display surface is comprised of roller members 36 and 52. Alternatively, casket lowering straps 37 may provide the display surface. The casket is aligned on the display surface and secured by placing the end of the casket against casket stop plate 35. The casket display and placing apparatus 15, 25 or 30 is temporarily fixed by a locking mechanism in a first position on the rigid base. The casket is then displayed during the burial service. After the service, casket display and placing apparatus 15 or 20 is moved by a wheeling device to a second position on a rigid base, in alignment over burial vault 67. If removable roller units 38 or other removable roller members are used, the units are moved out of the path of the casket prior to lowering the casket. The casket is then lowered by casket lowering straps 37 into burial vault 67.

Once the casket has been lowered into vault 67, straps 37 are loosened and pulled outward from under the casket. Straps 37 are then rewound, tightened and locked and casket display and placing assembly 15, 25 or 30 may be moved back to its first position on the rigid base in preparation for the next burial service.

As many changes are possible to the embodiments of this invention utilizing the teachings thereof, the descriptions above, and the accompanying drawings should be interpreted in the illustrative and not in the limited sense.

That which is claimed:

1. An assembly for displaying and placing a casket into a vault comprising:

a) said vault positioned on a rigid base;

b) a movable frame structure having an upper conveying portion constructed and arranged to have said casket placed thereon;

c) means to move said frame structure on said base, wherein said means to move said frame structure permits said frame structure to be positioned over said vault, thereby aligning said upper conveying portion with said vault;

d) stop means connected to said frame structure and being in alignment with said upper conveying portion to position said casket over said frame structure; and e) lowering means mounted to said frame structure to permit said casket to be lowered into said vault.

2. The assembly of claim 1, wherein said rigid base has a surface and a lowered pit area and wherein said lowered pit area is constructed and arranged to hold at least one said vault.

3. The assembly of claim 1, wherein said rigid base further comprises a base platform selected from the group of platforms consisting of a wooden platform and a concrete slab.

4. The assembly of claim 1, wherein said means to move said frame structure is comprised of a plurality of wheels mounted to said frame structure.

5. The assembly of claim 4, wherein said rigid base has a track system mounted thereto and wherein said wheels are adapted for rolling on said track system.

6. The assembly of claim 5, wherein said rigid base includes a lowered pit area therein and wherein said lowered pit area is constructed and arranged to hold at least one said vault, and wherein said track system is mounted adjacent said lowered pit area to align said casket with said vault.

7. The assembly of claim 1, wherein said upper conveying portion is comprised of a plurality of rollers connected to said frame structure that are removable from a lowering path of said frame structure.

8. The assembly of claim 1, wherein said stop means is comprised of a plate member mounted on said frame and a roller member in communication with said frame having means to immobilize said roller member.

9. The assembly of claim 1, wherein said lowering means is comprised of a plurality of extendible straps connected to said frame structure.

10. The assembly of claim 1, wherein said frame has an outer periphery and wherein drapery is attached to said outer periphery.

11. A method for displaying and placing a casket into a vault comprising:

a) conveying said casket onto a display surface of a casket display and placing apparatus, said apparatus being positioned on a base having said vault positioned thereon;

b) aligning and securing said casket on the display surface of the apparatus;

c) displaying the casket on the display surface;

d) aligning the casket display and placing apparatus over the vault; and e) lowering the casket from the display surface into the vault.

12. The method of claim 11, wherein the casket display and placing apparatus is a movable cart frame structure having a plurality of wheels constructed and arranged to move the apparatus on the base and a lowering mechanism assembly.

13. The method of claim 12, wherein said display and placing apparatus is in a first position when it is aligned and secured.

14. The method of claim 13, wherein said casket display and placing apparatus is aligned over the vault by conveying the apparatus to a second position on the base and in alignment over the vault.

15. The method of claim 14, wherein the casket is lowered by means of straps connected to the casket display and placing apparatus.

16. The method of claim 13, wherein the casket display and placing apparatus is returned to said first position after the casket is lowered into the vault.

17. The method of claim 11, wherein said base has a lowered pit area therein and wherein said lowered pit area is constructed and arranged to hold at least said one vault.

18. The method of claim 17, wherein said casket display and placing apparatus is moved over said lowered pit area prior to lowering the casket from the display surface into the vault.

19. A burial service ceremony site assembly for displaying and placing a casket into a vault comprising:

a) a base and said vault positioned thereon;

b) a display and placement apparatus having a conveyor means thereon for placing and positioning said casket upon said apparatus;

c) a means to move said apparatus on said base; and d) a lowering means to place said casket into said vault.

20. The site assembly of claim 19, wherein said display and placement apparatus is comprised of a movable cart assembly constructed and arranged to be positioned over said vault and said lowering means, said lowering means including a lowering mechanism assembly.

21. The site assembly of claim 20, wherein said movable cart assembly has means to immobilize said cart for temporarily fixing said cart in a specified position on said base.

22. The site assembly of claim 19, wherein said lowering means is comprised of a lowering mechanism having lowering straps.

23. The site assembly of claim 19, wherein said base has a lowered pit area therein and wherein said lowered pit area is constructed and arranged to hold at least one said vault.

24. The site assembly of claim 19, wherein said means to move said apparatus is comprised of a set of wheels mounted to said display and placement apparatus, wherein said base further comprises opposing tracks mounted thereto, wherein said base further has a lowered pit area therein and positioned between said opposing tracks and wherein said pit area is further constructed and arranged to hold at least one said vault.

* * * * *